US008408152B1

(12) United States Patent
Tarr

(10) Patent No.: US 8,408,152 B1
(45) Date of Patent: Apr. 2, 2013

(54) METHOD FOR CLEANING ANCHOR RODE

(76) Inventor: Charles E. Tarr, Brooksville, ME (US)

( * ) Notice: Subject to any disclaimer, the term of this patent is extended or adjusted under 35 U.S.C. 154(b) by 0 days.

(21) Appl. No.: 13/302,311

(22) Filed: Nov. 22, 2011

(51) Int. Cl.
*B63B 21/22* (2006.01)

(52) U.S. Cl. ..... 114/210; 114/364

(58) Field of Classification Search ..... 114/210, 114/293, 364
See application file for complete search history.

(56) References Cited

U.S. PATENT DOCUMENTS 1,704,363 A * 3/1929 Jones ..... 248/88
1,775,846 A * 9/1930 Blaw ..... 248/82
2,887,288 A * 5/1959 Buxbaum ..... 248/88
4,856,450 A * 8/1989 Lubahn ..... 114/293
6,374,765 B1 * 4/2002 Marotta ..... 114/293
6,651,909 B1 * 11/2003 Bugarin ..... 239/390

OTHER PUBLICATIONS

"Anchoring Part 4: Staying Put and Moving on" (p. 4) by Brad Hampton for YachtPals.com (May 13, 2010) http://yachtpals.com/anchoring-9078.

* cited by examiner

*Primary Examiner* — Stephen Avila
(74) *Attorney, Agent, or Firm* — Anthony D. Pellegrini

(57) ABSTRACT

An improved method for cleaning an anchor rode of a vessel utilizing a clamp member and a nozzle member, with the clamp member adapted to secure the nozzle member to the vessel such that water from a hose connected to the nozzle member is directed towards and onto the anchor rode as the anchor rode is taken up.

8 Claims, 4 Drawing Sheets

PRIOR ART

METHOD FOR CLEANING ANCHOR RODE

BACKGROUND OF THE INVENTION

1. Technical Field

The invention relates generally to the field of nautical accessories and is directed to an improved method of cleaning anchoring gear. More specifically, the invention is directed to an improved method for directing water onto an anchor rode as the anchor rode is being taken up, thereby cleansing the anchor rode of accumulated bottom mud and debris before the anchor rode is brought into the vessel.

2. Description of Prior Art

Most larger water vessels, such as sail boats, power boats, cabin cruisers, and the like, use an anchoring system to stay in place while on the water in a harbor, in both marine and fresh water environments. A typical anchoring system will comprise an anchor, an anchor rode, and an anchor line. The anchor is typically a specifically configured, relatively heavy device designed to engage with the bottom. The anchor rode is typically a relatively short length of chain, with one end connected to the anchor and the other end connected to the anchor line. The anchor rode is designed to lie on the bottom when the anchor is deployed, thereby reducing the possibility of drag. The anchor line is typically a relatively long length of nylon or other suitable type of rope, with one end connected to the anchor rode and the other end connected to the vessel. Alternately, the anchor line may consist entirely of chain, with the terminal end of the anchor line serving as the anchor rode.

On larger vessels, an anchoring system take up mechanism is typically employed to assist with the deployment and take up of the anchoring system. A typical anchoring system take up mechanism is a powered winch, onto which is wound the anchor line and at least a portion of the anchor rode. A hand operated winch may also be used. Particularly with larger vessels, the anchoring system take up mechanism is integrated within the bow of the vessel, such that, when fully taken up, the anchor line and at least a portion of the anchor rode are located within the vessel.

The bottom onto which an anchor and anchor rode are placed is often muddy or covered with vegetation, such as seaweed. The anchor and the anchor rode will dig into the mud and/or vegetation when deployed, thereby holding the vessel fast to the bottom. However, upon take up of the anchoring system, mud and/or vegetation often clings to the anchor and anchor rode. Thus when the anchor rode is fully taken up into the bow of the vessel, bottom debris also enters the vessel. This not only creates a mess within the vessel but may also foul the anchoring system take up mechanism, preventing smooth deployment and take up of the anchor.

To address the problem of fouled anchor rodes, many vessels have the capability of directing a spray of water onto the anchor rode as it is being taken up. This is most often done be using a water hose connected to a water pump, whereby the water pump draws in water and forces it through the water hose. A sailor holding the water hose will direct the end of the water hose towards the anchor rode as it is being taken up, washing off the bottom mud and/or vegetation with the water spray. A nozzle fitted to the end of the water hose may be used to increase the exit water pressure, thereby improving the cleaning capability of the water spray. See FIG. 1.

However, though the above-described solution is effective, it is often difficult to employ. A sailor must hold the end of the water hose and direct it towards the anchor rode during take up. Often the water will be rough and the vessel may pitch, making standing on the bow to accomplish the task difficult or even dangerous. In addition, a sailor standing at the bow directing a spray of water at the anchor rode will have a difficult time simultaneously controlling the anchoring system take up mechanism. If the anchor rode is particularly fouled the anchoring system take up mechanism may have to be stopped periodically to allow for longer exposure of the anchor rode to the water spray. Starting and stopping the anchoring system take up mechanism while holding a water hose is difficult for a single sailor to accomplish, especially on rough water.

What is needed, then, is a method of cleaning an anchor rode that does not require a sailor to stand at the bow holding a water hose.

It is therefore an objective of the present invention to provide an improved method of cleaning an anchor rode that does not require a sailor to stand at the bow holding a water hose.

It is a further objective of the present invention to provide an improved method of cleaning an anchor rode that utilizes a device for properly positioning a water hose.

It is a further objective of the present invention to provide an improved method of cleaning an anchor rode that utilizes a device that allows for easy connection and disconnection of the water hose to the device.

It is a further objective of the present invention to provide an improved method of cleaning an anchor rode that is simple to perform.

It is a further objective of the present invention to provide an improved method of cleaning an anchor rode that utilizes a device that is attachable to and removable from a vessel.

It is a further objective of the present invention to provide an improved device that can be utilized by the improved method of the present invention to properly position a water hose.

It is a further objective of the present invention to provide an improved device for cleaning an anchor rode that provides for easy connection and disconnection of the water hose.

It is a further objective of the present invention to provide an improved device for cleaning an anchor rode that is inexpensive to manufacture.

It is a further objective of the present invention to provide an improved device for cleaning an anchor rode that is attachable to and removable from a vessel.

Other objectives of the present invention will be readily apparent from the description that follows.

SUMMARY OF THE INVENTION

The present invention discloses an improved method of cleaning an anchor rode. In one aspect, the present invention is directed to a method that utilizes a device for properly positioning a water hose such that a spray of water from the water hose is directed onto an anchor rode as the anchor rode is being taken up. The method comprises the steps of attaching the device to the bow of the vessel; orienting the device such that it is directed towards the anchor rode; connecting the end of the water hose to the device; initiating water flow through the water hose; and taking up the anchor rode. As these steps are performed water flows through the water hose and into and through the device, such that water is directed onto the anchor rode, washing off bottom debris.

In another aspect of the present invention, a device is disclosed which may be utilized by the method of the present invention. The device comprises a clamp member that is suitably adapted to be attached to the bow of a vessel, and a nozzle member that is suitably adapted to be attached to the end of a water hose. The clamp member is suitably adapted to hold the nozzle member in an appropriate orientation to direct a spray of water onto the anchor rode.

Other features and advantages of the invention are described below.

DETAILED DESCRIPTION OF THE INVENTION

Figure 1:
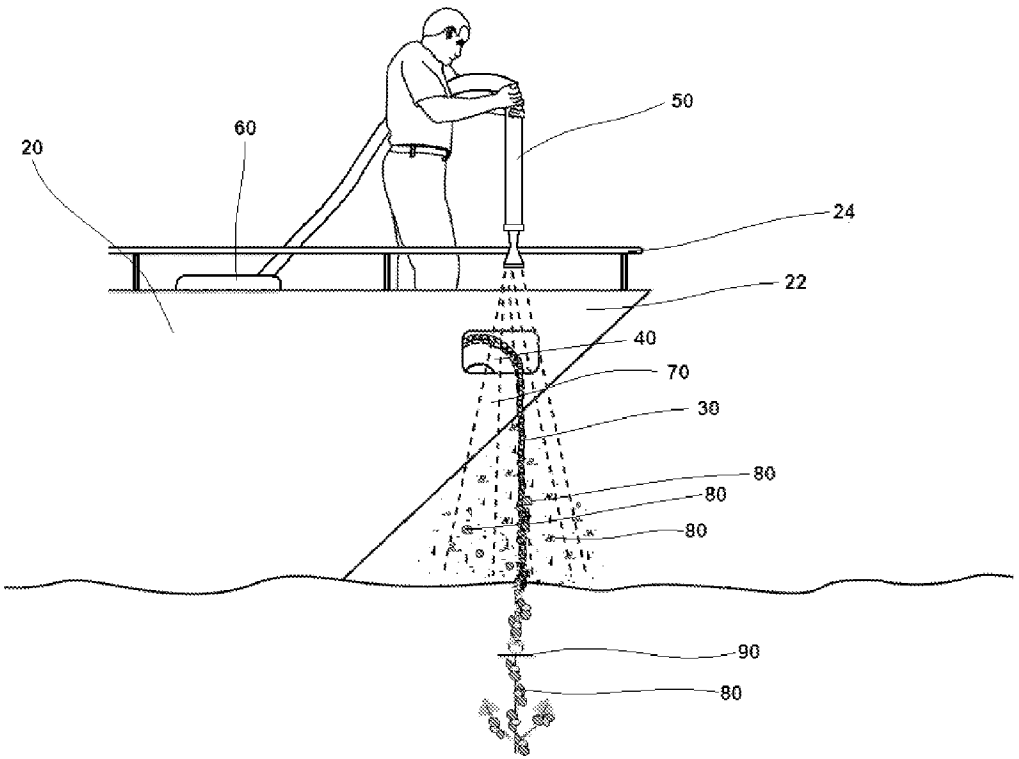
FIG. 1 is a stylized depiction of the prior art, whereby a sailor standing at the bow of a vessel holds a water hose and directs a spray of water onto the anchor rode as the anchor rode is being taken up by an anchoring system take up mechanism.

The method disclosed herein is for the cleaning of a deployed anchor rode 30 of a vessel 20. The method may be used on any type of vessel 20, primarily a boat or a barge, that utilizes an anchoring system for retaining the vessel 20 in place while on the water in a harbor and an anchoring system take up mechanism 40 to deploy and take up an anchor 90. The preferred type of vessel 20 for which the method is intended to be used is a sailboat, but power boats and other vessels 20 may also use the method. The method is equally useful for vessels 20 used in marine and in fresh water environments.

The method utilizes a water hose 50 and a device 10 suitably adapted to engage the water hose 50, attach it to the bow 22 of a vessel 20, and position the flow of water 70 from the water hose 50 to effectively clean the anchor rode 30 as the anchor 90 is being taken up. The water hose 50 may be any flexible hose typically used on boats. For example, many boats incorporate a water pump 60 with an attached water hose 50 and an intake hose, where the intake hose is placed overboard into the water. The pump 60 draws in water 70 and sends it flowing through the water hose 50, where it can be directed to wash the decking of the vessel 20, for example. Preferably, the water hose 50 will have a distal end 52 that is threaded and of standard size, most preferably having a one inch inside diameter end. An example of an appropriate type of water hose 50 is a standard garden hose.

The device 10 utilized by the method comprises a clamp member 100 that is suitably adapted to be attached to the bow 22 of the vessel 20, and a nozzle member 200 that is suitably adapted to be attached to the end 52 of the water hose 50. The clamp member 100 is suitably adapted to hold the nozzle member 200 in an appropriate orientation to direct a spray of water 70 onto the anchor rode 30.

The basic method of the present invention comprises the following steps:

A. attach the first end 110 of the clamp member 100 of the device 10 to the bow 22 of the vessel 20;

B. attach the nozzle member 200 of the device 10 to the second end 120 of the clamp member 100;

C. orient the nozzle member 200 such that its second end 212 is directed towards the anchor rode 30;

D. connect the end 52 of the water hose 50 to the first end 210 of the nozzle member 200;

E. initiate the flow of water 70 through the water hose 50; and

F. take up the anchor rode 30.

Figure 4:
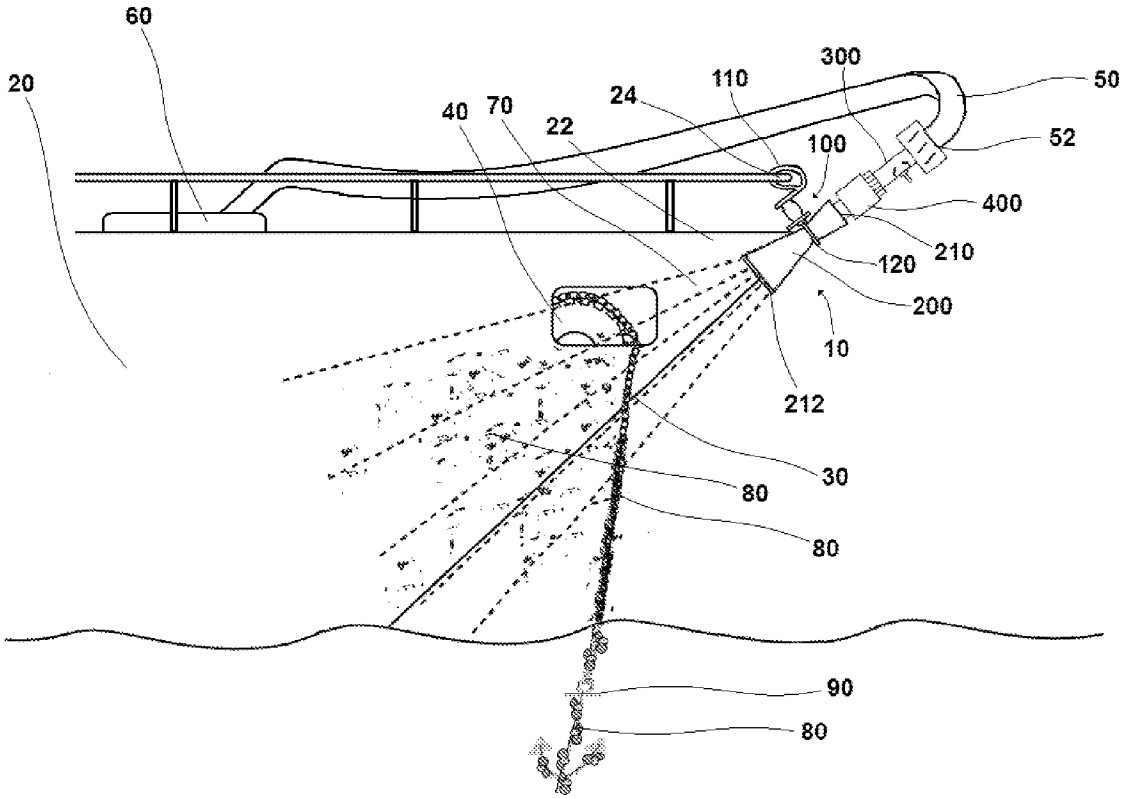
FIG. 4 is a stylized depiction of the device and method of the present invention, whereby the claimed device is attached to the bow rail of the vessel and directs a spray of water onto the anchor rode as the anchor rode is being taken up by an anchoring system take up mechanism, causing bottom debris to be removed from the anchor rode.

Steps A and B may be performed in any order with regard to each other. Steps B and D may be performed in any order with regard to each other. Step C occurs after Step B. Steps E and F may be performed in any order with regard to each other. After Steps C, D, and E are performed, water 70 flows through the water hose 50, into the nozzle member 200, and out the second end 212 of the nozzle member 200, such that water 70 is directed onto the anchor rode 30. This spray of water 70 effectively washes bottom debris and mud 80 from the anchor rode 30. See FIG. 4.

Figure 2:
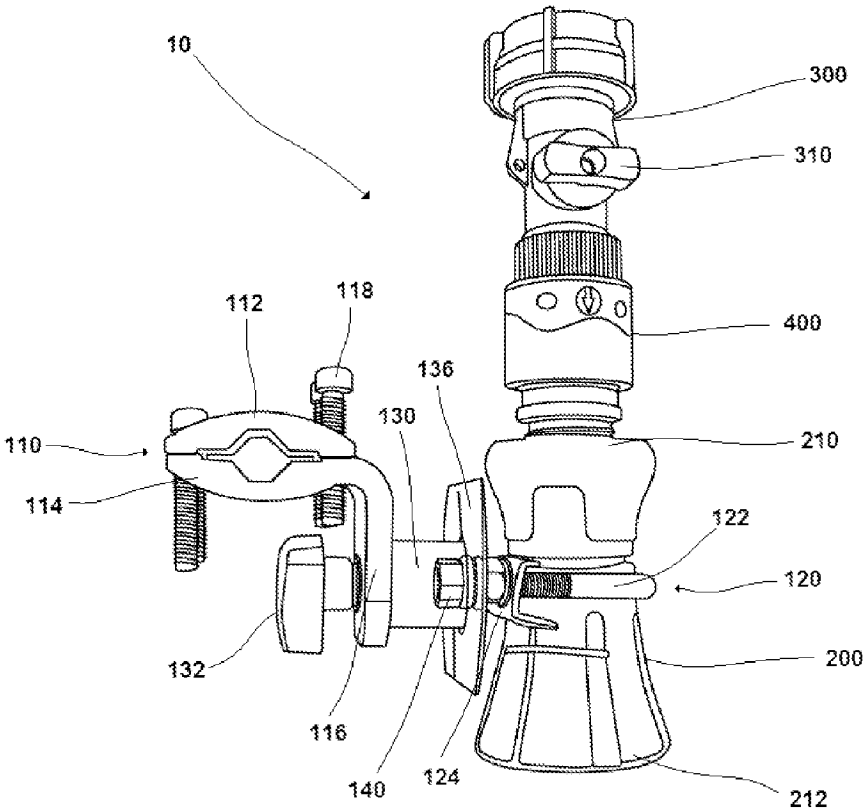
FIG. 2 is a perspective side view of the claimed device used in the claimed method of the present invention.

In one aspect of the method, the first end 110 of the clamp member 100 is attached to the bow rail 24 of the vessel 20. A bow rail 24 is located on the bow 22 of a vessel 20, and is usually formed of a rigid material, such as aluminum or another type of metal. A bow rail 24 typically has a rounded configuration, with a cross section measuring between one half inch and one inch, though other configurations and sizes may also be used. In this aspect of the method the first end 110 of the clamp member 100 comprises of a pair of jaws 112,114, with the first jaw 112 and the second jaw 114 being suitably adapted to engage with the bow rail 24 on opposite sides of the bow rail 24 from each other. See FIG. 2. In the preferred embodiment each jaw 112,114 is curved and has grips along the inside edge, to minimize slippage while placed against the bow rail 24. The jaws 112,114 may be constructed of any suitable rigid, durable material, such as metal or composites. The jaws 112,114 are placed on either side of the bow rail 24 and then secured thereto. This may be done by the use of threaded bolts 118 which removably attach the first jaw 112 to the second jaw 114. When the bolts 118 are tightened the jaws 112,114 grip the bow rail 24 in a fixed orientation. Using this configuration for the first end 110 of the clamping member 100 allows the clamping member 100 to be easily positioned relative to the bow rail 24 when the threaded bolts 118 are loose, and then, when the desired orientation is achieved, the clamping member 110 is fixed into place by tightening the bolts 118. Moreover, the device 10 may be easily removed from the bow rail 24 simply by loosening the jaws 112,114.

Figure 3:
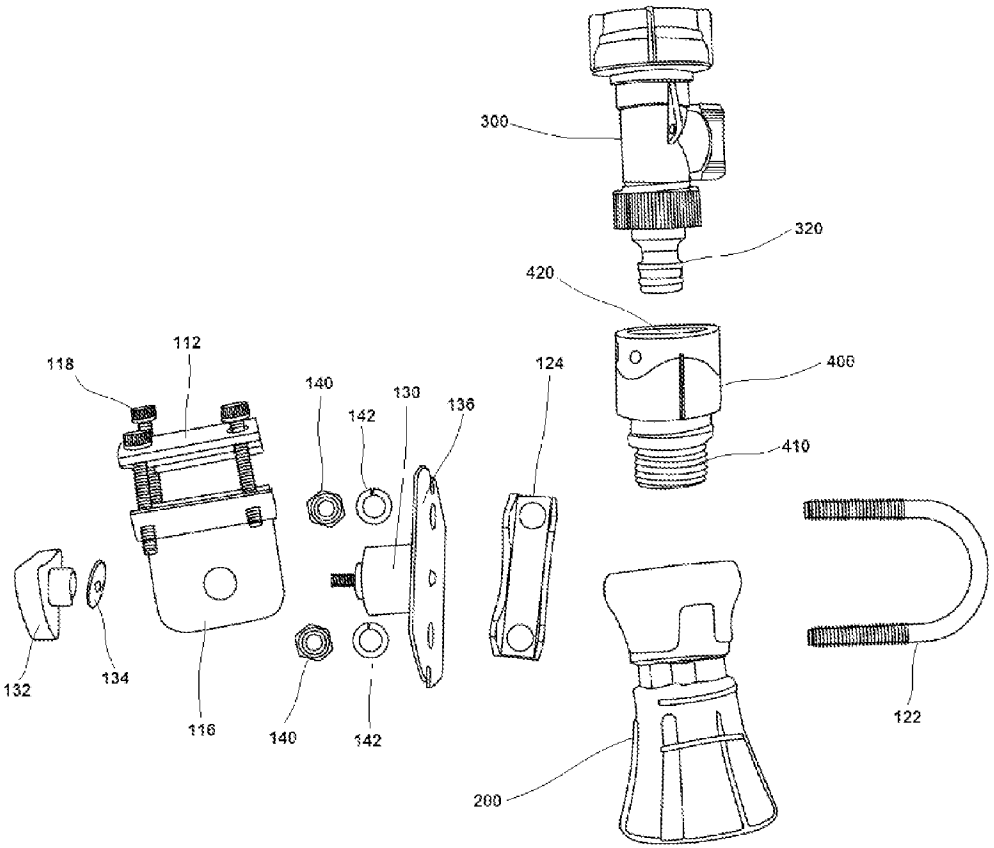
FIG. 3 is an exploded view of the device depicted in FIG. 2.

In another aspect of the method, the second end 120 of the clamp member 100 is attached to the nozzle member 200. Any suitable configuration of attachment mechanism may be used to attach the nozzle member 200 to the second end 120 of the clamp member 100. In the preferred embodiment the nozzle member 200 is removably attached to the second end 120 of the clamp member 100, allowing the nozzle member 200 to be easily cleaned or replaced, or removed to be used for other purposes. In the most preferred embodiment the second end 120 of the clamp member 100 comprises a collar 122 and a securing plate 124. See FIGS. 2 and 3. The collar 122 is U-shaped, made of a durable and rigid material, such as stainless steel, and has threaded ends. The securing plate 124 is rigid, substantially planar, and comprises a pair of apertures suitably adapted to accommodate the threaded ends of the collar 122. The collar 122 is placed around the nozzle member 200, then the securing plate 124 is placed against the opposite side of the nozzle member 200, with the threaded ends of the collar 122 passing through the corresponding apertures of the securing plate 124. Threaded nuts 140 and lock washers 142 may be used to secure the securing plate 124 to the collar 122. The securing plate 124 is then attached to the first end 110 of the clamp member 100.

In yet another aspect of the method, the second end 120 of the clamp member 100 further comprises a pivot mechanism 130. The pivot mechanism 130 allows the nozzle member 200 to be moved relative to the first end 110 of the clamp member 100. In one embodiment the pivot member 130 comprises a face plate 136 and a pivot shaft, with the pivot shaft attached to the face plate 136 and oriented substantially perpendicular to the face plate 136. See FIG. 3. The face plate 136 is substantially planar and rigid, preferably constructed of stainless steel. In the preferred embodiment the face plate 136 comprises a pair of apertures, said apertures located on the face plate 136 such that they may be aligned with the apertures of the securing plate 124. In this embodiment the pivot shaft comprises a threaded rod extending outward along the longitudinal axis of the pivot shaft, and a threaded knob 132 suitably adapted to be threaded onto the end of the threaded rod. The face plate 136 is positioned against the securing plate 124, and the threaded ends of the collar 122 of the second end 120 of the clamp member 100 are passed through both the apertures of the securing plate 124 and the apertures of the face plate 136, then secured with threaded nuts 140 and lock washers 142. The pair of jaws 112,114 of the first end 110 of the clamp member 100 further comprise a rigid flange 116 that extends substantially perpendicular to the pair of jaws 112,114. The flange 116 comprises an aperture suitably adapted to accommodate the threaded rod of the pivot shaft. The threaded rod of the pivot shaft is placed through the aperture of the flange 116 and then the threaded knob 132 is secured to the threaded rod. A washer 134 may be interposed between the threaded knob 132 and rhe pivot shaft. See FIG. 2. So configured, the clamp member 100 allows the nozzle member 200 to be correctly oriented by loosening the threaded knob 132, thereby allowing the second end 120 of the clamp member 100 to be rotated relative to the first end 110 of the clamp member 100. Once the desired orientation is achieved the threaded knob 132 is tightened, locking the first and second ends 110,120 of the clamping member 100 in place relative to each other. The combination of the pivoting of the nozzle member 200 as described in this paragraph and the positioning of the first end 110 of the clamping member 100 relative to the bow rail 24 accomplishes Step C of the method.

In yet another aspect of the method, Step D, whereby the end 52 of the water hose 50 is connected to the first end 210 of the nozzle member 200, is comprised of two substeps. Substep D' comprises connecting a quick-connect interface member 300 to the end 52 of the water hose 50. Substep D" comprises connecting the quick-connect interface member 300 to the first end 210 of the nozzle member 200. Substeps D' and D" may be performed in any order with regard to each other. The quick-connect interface member 300 is located between the end 52 of the water hose 50 and the first end 210 of the nozzle member 200. The quick-connect interface member 300 is suitably adapted to be removably attached to the end 52 of the water hose 50 and to be removably attached to the first end 210 of the nozzle member 200. See FIG. 3. In the preferred embodiment, Substep D" further comprises Substep DD' and DD". Substep DD' comprises connecting a coupler 400 to the first end 210 of the nozzle member 200. Substep DD" comprises connecting the coupler 400 to the quick-connect interface member 300. Substeps D', DD', and DD" may be performed in any order with regard to each other. The coupler 400 is interposed between the quick-connect interface member 300 and the first end 210 of the nozzle member 200. See FIG. 3. The coupler 400 is suitably adapted to be removably attached to the first end 210 of the nozzle member 200 and to be removably attached to the quick-connect interface member 300. In this embodiment, the coupler 400 comprises an open receiving end 420 and a threaded end 410 located opposite the open receiving end 420. The threaded end 410 of the coupler 400 is suitably adapted to be threaded into threads formed into the first end 210 of the nozzle member 200. The quick-connect interface member 300 further comprises a nipple 320 located at one end. The nipple 320 is suitably adapted to be inserted into the receiving end 410 of the coupler 400. A retractable ring secures the quick-connect interface member 300 to the coupler 400; retraction of the ring allows the quick-connect interface member 300 to be inserted into or withdrawn from the coupler 400.

In yet another aspect of the method, Step E, whereby the flow of water 70 is initiated through the water hose 50, is comprised of two substeps. Substep E' comprises initiating a water moving mechanism 60 suitably adapted to move water 70 into and through the water hose 50 such that water 70 flows into and through the water hose 50. Substep E" comprises using a switch 310 to position a valve to an opened position to allow the water 70 to flow through the nozzle member 200. Substeps E' and E" may be performed in any order with regard to each other. The water moving mechanism 60 is preferably an electric water pump. In the preferred embodiment the valve and the switch 310 are components of the quick connect interface member 300. The valve is located in an interior portion of the quick connect interface member 300. It is suitably adapted to be positioned to an opened position and to a closed position, whereby water is capable of flowing through the quick connect interface member 300 when the valve is in the opened position and water is prevented from flowing through the quick connect interface member 300 when the valve is in the closed position. The switch 310 is suitably adapted to position the valve in either the opened position or the closed position. In this aspect of the method, two additional steps may be performed. Step G comprises using the switch 310 to position the valve to the closed position, and Step H comprises stopping movement of the anchor rode 30. Steps G and H are performed after Steps E and F, and Steps G and H may be performed in any order with regard to each other. Steps G and H may be performed two or more times, with substep E" and Step F performed after each performance of Steps G and H except for the last performance of Steps G and H, with substep E" and Step F performed in any order with regard to each other. These steps may be performed when the operation of the cleaning method needs to be interrupted.

In yet another aspect of the method, the method further comprises a Step C', whereby the nozzle member 200 may be manipulated to set the volume and pressure of water 70 flowing out of the nozzle member 200. Step C' may be performed in any order with regard to each other step. In the preferred embodiment Step C' is accomplished by the nozzle member 200 further comprising a variable restricting mechanism. Operation of the variable restricting mechanism allows for variation in the volume and pressure of water 70 flowing out of the nozzle member 200. The variable restricting mechanism may be a diaphragm that restricts the inside diameter of the nozzle member 200. It may be an internal threaded rod that extends into an interior chamber, whereby extending the rod places more of it into the chamber, thereby restricting the volume of water that may pass through the chamber at a given time. Other means for restricting the flow of water through the nozzle member 200 are also contemplated.

In yet another aspect of the present invention, the device 10 described herein, in all its embodiments, is claimed.

Modifications and variations can be made to the disclosed embodiments of the method and device 10 without departing from the subject or spirit of the method and device 10 as defined in the following claims.

What is claimed is:

1. A method for cleaning a deployed anchor rode of a vessel, said vessel having an anchoring system comprising an anchor attached to said anchor rode, and an anchoring system take up mechanism, said anchoring system take up mechanism suitably adapted to deploy said anchor by releasing at least a portion of said anchor rode and adapted to take up said anchor by drawing at least a portion of said anchor rode into said vessel, said method utilizing a clamp member suitably adapted to be attached to a bow of said vessel, a nozzle member, with said nozzle member having an interior portion and a first end and a second end, with the first and second ends of said nozzle being opened so that fluid may enter said nozzle member through the opened first end and exit said nozzle member through the opened second end, said nozzle member suitably adapted to be held by said clamp member in an appropriate orientation to direct the second end of said nozzle member towards said anchor rode when said anchor rode is deployed, and a quick-connect interface member located between the end of the water hose and the first end of the nozzle member, whereby said quick-connect interface member is suitably adapted to be removably attached directly to the end of the water hose and said quick-connect interface member is suitably adapted to be removably attached, either directly or indirectly, to the first end of the nozzle member, said method comprising the following steps:

A. attach a first end of said clamp member to said bow of said vessel;

B. attach said nozzle member to a second end of said clamp member, said second end of said clamp member being distal from said first end of said clamp member;

C. orient said nozzle member such that its second end is directed towards said deployed anchor rode;

D. connect the end of the water hose to the first end of said nozzle member by performing the following substeps:

D'. connect said quick-connect interface member directly to the end of the water hose; and D". connect said quick-connect interface member, either directly or indirectly, to the first end of the nozzle member;

E. initiate water flow through said water hose; and

F. take up said deployed anchor rode;

wherein Steps A and B may be performed in any order with regard to each other;

Steps B and D may be performed in any order with regard to each other;

substeps D' and D" may be performed in any order with regard to each other; Step C occurs after Step B; and Steps E and F may be performed in any order with regard to each other;

whereby after Steps C, D, and E are performed water flows through said water hose, into said nozzle member, and out the second end of said nozzle member such that water is directed onto said deployed anchor rode.

2. The method of claim 1 wherein the quick connect interface member further comprises a valve and a switch, whereby said valve is located in an interior portion of the quick connect interface member and said valve is suitably adapted to be positioned to an opened position and to a closed position, whereby fluid is capable of flowing through the quick connect interface member when said valve is in the opened position and whereby fluid is prevented from flowing through the quick connect interface member when said valve is in the closed position, and wherein said switch is suitably adapted to position said valve in either the opened position or the closed position, wherein said Step E comprises the following substeps:

E'. initiate a water moving mechanism suitably adapted to move water into and through the water hose such that water flows into and through the water hose; and E". use said switch to position said valve to the opened position;

whereby substeps E' and E" may be performed in any order with regard to each other.

3. The method of claim 2 wherein the water moving mechanism is a pump.

4. The method of claim 2 further comprising the following steps:

G. use said switch to position the valve to the closed position; and

H. stop movement of the anchor rode;

whereby Steps G and H are performed after Steps E and F and Steps G and H may be performed in any order with regard to each other.

5. The method of claim 4 wherein Steps G and H may be performed two or more times, with substep E" and Step F performed after each performance of Steps G and H except for the last performance of Steps G and H, with substep E" and Step F performed in any order with regard to each other.

6. The method of claim 1 wherein Step D further comprises a coupler, said coupler interposed between the quick-connect interface member and the first end of the nozzle member, whereby said coupler is suitably adapted to be removably attached directly to the first end of the nozzle member and said coupler is suitably adapted to be removably attached directly to said quick-connect interface member, wherein substep D" comprises the following substeps:

DD'. connect said coupler directly to the first end of the nozzle member; and

DD". connect said coupler directly to the quick-connect interface member;

whereby substeps D', DD', and DD" may be performed in any order with regard to each other.

7. A method for cleaning a deployed anchor rode of a vessel, said vessel having an anchoring system comprising an anchor attached to said anchor rode, and an anchoring system take up mechanism, said anchoring system take up mechanism suitably adapted to deploy said anchor by releasing at least a portion of said anchor rode and adapted to take up said anchor by drawing at least a portion of said anchor rode into said vessel, said method utilizing a clamp member suitably adapted to be attached to a bow of said vessel, a nozzle member, with said nozzle member having an interior portion and a first end and a second end, with the first and second ends of said nozzle being opened so that fluid may enter said nozzle member through the opened first end and exit said nozzle member through the opened second end, the first end of said nozzle member suitably adapted to engage an end of a water hose, said nozzle member suitably adapted to be held by said clamp member in an appropriate orientation to direct the second end of said nozzle member towards said anchor rode when said anchor rode is deployed, and said nozzle member having a variable restricting mechanism, whereby operation of said variable restricting mechanism allows for variation in the volume and pressure of water flowing out of the nozzle member, said method comprising the following steps:

A. attach a first end of said clamp member to said bow of said vessel;

B. attach said nozzle member to a second end of said clamp member, said second end of said clamp member being distal from said first end of said clamp member;

C. orient said nozzle member such that its second end is directed towards said deployed anchor rode;

C'. manipulate said variable restricting mechanism to set the volume and pressure of water flowing out of the nozzle member;

D. connect the end of the water hose to the first end of said nozzle;

E. initiate water flow through said water hose; and

F. take up said deployed anchor rode;

wherein Steps A and B may be performed in any order with regard to each other;

Steps B and D may be performed in any order with regard to each other;

Step C occurs after Step B;

Step C' may be performed in any order with regard to each other step; and

Steps E and F may be performed in any order with regard to each other;

whereby after Steps C, C', D, and E are performed water flows through said water hose, into said nozzle member, and out the second end of said nozzle member such that water is directed onto said deployed anchor rode.

8. The method of claim 2 wherein Step D further comprises a coupler, said coupler interposed between the quick-connect interface member and the first end of the nozzle member, whereby said coupler is suitably adapted to be removably attached directly to the first end of the nozzle member and said coupler is suitably adapted to be removably attached directly to said quick-connect interface member, wherein substep D" comprises the following substeps:

DD'. connect said coupler directly to the first end of the nozzle member; and

DD". connect said coupler directly to the quick-connect interface member;

whereby substeps D', DD', and DD" may be performed in any order with regard to each other.

* * * * *